US010062270B2

(12) United States Patent
Skolnik et al.

(10) Patent No.: US 10,062,270 B2
(45) Date of Patent: Aug. 28, 2018

(54) ALARM SYSTEM RESPONSE TIME REDUCTION

(71) Applicants: Jay Skolnik, Albuquerque, NM (US); Daniel Skolnik, Albuquerque, NM (US); Connor Harness, Albuquerque, NM (US); Jun-Min Lee, Albuquerque, NM (US)

(72) Inventors: Jay Skolnik, Albuquerque, NM (US); Daniel Skolnik, Albuquerque, NM (US); Connor Harness, Albuquerque, NM (US); Jun-Min Lee, Albuquerque, NM (US)

(73) Assignee: KONTRA TECHNOLOGIES, INC., Wilmington, DE (US)

( * ) Notice: Subject to any disclaimer, the term of this patent is extended or adjusted under 35 U.S.C. 154(b) by 0 days.

(21) Appl. No.: 15/432,316

(22) Filed: Feb. 14, 2017

(65) Prior Publication Data

US 2017/0236404 A1 Aug. 17, 2017

Related U.S. Application Data

(60) Provisional application No. 62/295,455, filed on Feb. 15, 2016, provisional application No. 62/396,058, filed on Sep. 16, 2016, provisional application No. 62/457,550, filed on Feb. 10, 2017.

(51) Int. Cl.

| | |
|---|---|
| ***G08B 25/14*** | (2006.01) |
| ***G08B 19/00*** | (2006.01) |
| ***G08B 25/10*** | (2006.01) |
| ***G08B 25/00*** | (2006.01) |
| ***G08B 27/00*** | (2006.01) |

(52) U.S. Cl.

CPC ..... *G08B 25/14* (2013.01); *G08B 25/006* (2013.01); *G08B 27/003* (2013.01)

(58) Field of Classification Search

CPC ..... G04G 13/021; G08B 3/10; G08B 25/001; G08B 25/002; G08B 25/004; G08B 25/006; G08B 25/008; G08B 25/009; G08B 25/016; G08B 25/08; G08B 25/10; G08B 25/14; G08B 27/003

USPC ..... 340/539.13

See application file for complete search history.

(56) References Cited

U.S. PATENT DOCUMENTS

| | | | | |
|---|---|---|---|---|
| 5,131,019 A * | 7/1992 | Sheffer | G08B 25/009 379/39 |
| 6,249,221 B1 * | 6/2001 | Reed | G08B 1/08 340/286.05 |
| 9,277,310 B1 * | 3/2016 | Nohr | H04R 1/1041 |
| 9,330,559 B1 * | 5/2016 | Ryan | G08B 5/36 |
| 9,472,092 B1 * | 10/2016 | Grant | G08B 29/126 |

(Continued)

*Primary Examiner* — Quan-Zhen Wang
*Assistant Examiner* — Stephen Burgdorf
(74) *Attorney, Agent, or Firm* — Melissa Silverstein Law PLLC; Melissa Silverstein

(57) ABSTRACT

An alarm system is monitored by an alert system that supplements the capabilities of the alarm system. The sensors, such as door, window, fire, and CO sensor can be monitored by the alarm system which can raise an alarm when a sensor is triggered. The alert system detects that the alarm system has raised an alarm. The alert system can then communicate the alarm locally to other alert system installations. People at those other alert system installations are thereby alerted to the alarm and can respond to it.

8 Claims, 5 Drawing Sheets

(56) References Cited

U.S. PATENT DOCUMENTS

| | | | | |
|---|---|---|---|---|
| 2004/0137959 | A1* | 7/2004 | Salzhauer | G08B 1/08 455/567 |
| 2006/0017579 | A1* | 1/2006 | Albert | G04G 13/021 340/628 |
| 2014/0062693 | A1* | 3/2014 | Watts | G08B 27/006 340/539.11 |
| 2015/0015395 | A1* | 1/2015 | Liang | G08B 21/0415 340/539.17 |
| 2015/0077737 | A1* | 3/2015 | Belinsky | G01N 15/0211 356/51 |

* cited by examiner

ALARM SYSTEM RESPONSE TIME REDUCTION

RELATED APPLICATIONS

This application claims the benefit and priority of U.S. Provisional Application 62/295,455, filed Feb. 15, 2016, entitled "Alarm System for Reducing Response Time," the priority and benefit of U.S. Provisional Application 62/396,058, filed Sep. 16, 2016, entitled "Neighbor to Neighbor Emergency Aiding System," and the priority and benefit of U.S. Provisional Application 62/457,550, filed Feb. 10, 2017, entitled "Alarm System Response Time Reduction." U.S. Provisional Applications 62/295,455, 62/396,058, and 62/457,550 are herein incorporated by reference in their entirety.

TECHNICAL FIELD

Embodiments are related to alarm systems, alarm signals, alarm monitoring, and wireless communications.

BACKGROUND

Embodiments are related to alarm systems, alarm signal, alarm monitoring, and wireless communications.

The typical series of events that occur to get a responder on site, to the location where the alarm system has been triggered, takes anywhere from tens of minutes to hours, which gives criminals adequate time to burglarize and make their escape. Traditional alarm systems, when triggered, send a signal to a monitoring center, which then calls the owner of the property. The call is made to see if the alarm was somehow triggered by accident. If there is no answer to the call, additional calls may be placed to contact another responsible party. If a responsible party can not be contacted, or if an owner confirms that the alarm is not being triggered by accident, the monitoring center will alert local police departments to respond. Depending on the current load of a particular police force, an officer may be dispatched immediately. Often there is a police shortage in a city, and the dispatch must be queued based on priority of other situations. Once dispatched, the police officer proceeds to the location of the triggered alarm system. In a best case scenario, a police officer responds in roughly 10 minutes. Criminals, knowing this, use the slow response time to complete their business and leave before the police arrive.

In emergency situations, the people who can help, such as family, friends, and government services are usually physically far away from where the emergency is happening or are busy with situations that require more attention. If the emergency happens to be a fire, burglary, or heart attack, seconds can make a large difference to the outcome of the emergency. Fortunately, most humans live in relatively close proximity to others, deeming them as neighbors. If the proper information about the emergency were to be distributed to the neighbors in the time of an emergency, such as: the location, what type of emergency, people involved, etc.; then there would be a potentially massive reduction in negative outcomes from the emergency.

Alarm systems are designed to provide a means of security, safety, and peace of mind. An alarm system has sensors to monitor the opening of entrances to buildings, and provides a way to communicate a triggered alarm. Alarm systems allow buildings to be monitored remotely without anyone being physically in the building.

FIG. 1, labeled as prior art, illustrates an alarm system 101 with an audible alarm 106 and a communications channel 119 to a remote monitoring center 107. The alarm system 101 can have many sensors such as door sensors 108, movement sensors 110, water leak sensors 111, window sensors 112, smoke sensors 114, and fire sensor 115. A door sensor 108 can detect when a door 109 is opened or closed. A movement sensor 110 can detect movement in its local environment. A water leak sensor 111 can detect a water leak by, for example, detecting water pooling on the floor. A window sensor 112 can detect when a window 113 is opened or closed. A smoke sensor 114 can detect smoke. A fire sensor 115 can detect fire.

The sensors can communicate information to a control unit 102. The communication can be wireless or can transit a wire. Wireless communications techniques include Zigbee, Z-wave, Bluetooth, and other wireless techniques. A triggered sensor 116 is a sensor that has detected a triggering event 121. For example, opening a door can trigger a door sensor. The control unit can react to the trigger sensor by changing the state of a control signal 117 to thereby cause an audible alarm unit 104 sound an audible alarm 106, causing a visible alarm unit 105 to produce a visible alarm 123, or causing a reporting unit 103 to inform a remote monitoring center 107 of the triggered sensor 116. The audible alarm unit 104 can provide an alarm signal 118 to a sonic transducer 122, such as an audio speaker, that produces the audible alarm 106. FIG. 1 illustrates a single control signal 117 being passed to the audible alarm unit 104, reporting unit 103, and visible alarm unit 105 although, in practice, the control unit 102 can send different control signals to audible alarm unit 104, visible alarm unit 106, and reporting unit 103. In any case, the control signal or control signals carry information and change state in accordance with the control unit's programming, the alarm system configuration, and the triggered sensor 116.

Alarm systems for homes and businesses have been widely deployed and many homeowners and business owners are dissatisfied to have discovered that there is no or slow response to those alarms even when a monitoring service is being paid to monitor the alarm. Systems and methods for providing sufficient response to alarms are needed.

BRIEF SUMMARY

The following summary is provided to facilitate an understanding of some of the innovative features unique to the embodiments and is not intended to be a full description. A full appreciation of the various aspects of the embodiments can be gained by taking the entire specification, claims, drawings, and abstract as a whole.

It is therefore an aspect of the embodiments that an alert system enhances an alarm system. The alert system can be substantially separate from the alarm system. For example, a home monitoring company can install an alarm system in a home with the alarm system having a control unit and numerous sensors such as door sensors, window sensors, fire sensors, smoke sensors, water leak sensors, movement sensors, and CO sensors. The sensors are in communication with the control unit such that the control unit can detect when a sensor, the triggered sensor, has detected a triggering event has occurred such as a door opened, window opened/broken, or the presence of fire, smoke, water/flood, movement, or carbon monoxide. The control unit can raise an alarm in response to the triggering event. The alarm can be an audible alarm, visible alarm, or a silent alarm that is transmitted by a reporting unit to a remote monitoring. In general, a control signal within or output by the control unit changes state and the audible alarm, visible alarm, or reporting unit responds to the change of state by making noise, flashing lights, or informing the remote monitoring center.

A homeowner or other person can obtain and install an alert system to enhance the alarm system. For example, the response to the alarms or response of the remote monitoring center might be too slow to be meaningful. The alert system can include an alarm monitor that monitors the alarm system. The alarm monitor can be wired directly into the alarm system to, for example, directly receive the control signal. In other embodiments, the alarm monitor can listen for an audible alarm, watch for a visual alarm, or sense other information produced by the alarm system. In each of these scenarios, the alarm monitor either directly detects the control signal's change of state by monitoring the control signal itself or indirectly detects that the control signal has changed state by detecting an action that the alarm system takes such as sounding an alarm or sending information to a remote monitoring center. The alarm monitor can produce an alarm sensed output upon directly or indirectly detecting that the control signal has changed state. The alert system does not include alarm system components such as the control unit, the reporting unit, or the sensors being watched by the control unit. The alert system does include the alarm monitor. Furthermore, the alarm sensed output, produced by the alert system, is not to be confused with the control signal that is produced by the alarm system. The alarm system, with its control signal, does not include or encompass the alert system, alarm monitor, or alarm sensed output, It is another aspect of the embodiments that a wireless transmitter can transmit an alert signal in response to the alarm sensed signal. A remote console can receive the alert signal and, in response, generate an alert. The alert should be perceptible by a person, meaning that the person can sense the alert by seeing it, hearing it, or feeling it. A person can feel a signal via a haptic device. The alert informs the person of the triggering event and, in some embodiments, can provide details such as what the triggering event is, if the control signal carried such information, or where the alert is, if the alert signal carried such information. The alert can be displayed on a remote console. The remote console can be in a neighbor's house, in a friends pocket, or some other location, but is not at the remote monitoring center. The alert system is intended to improve responsiveness to alarms and it makes little sense for it to alert the very place and people that the alarm system communicates with.

It can be an aspect of the embodiments to sense the control signal on a wired connection between the control unit and an audible alarm unit. In some cases, the audible alarm unit is, in essence, an audio amplifier that amplifies the control signal itself to produce an alarm signal that is played by a sonic transducer, such as a speaker, to produce an audible alarm. In other cases, the control signal causes the alarm unit to generate an alarm signal that is played by a sonic transducer. The alarm monitor can directly monitor the control signal as it passes between control unit and audible alarm unit, the alarm signal emitted by the alarm unit, or the audible signal produced by the sonic transducer. Here, sonic transducer indicates a device that transforms electrical energy to sonic energy.

It is an aspect of the embodiments that a wireless transmitter can transmit an alert signal either directly or indirectly to a remote console. Direct transmission means that there are no intervening device such a repeaters, routers, wireless mesh network nodes, or similar devices. Indirect transmission indicates that there are intervening devices.

Intervening device can include a device or service hat interprets an alarm sensed output produced by an alarm monitor and that can alter the alarm sensed output or direct it to specific recipients. Such a device can be a rules engine that stores rules for interpreting the alarm sensed output. For example, when the alarm sensed output indicates the type of alarm, such as "motion detected at location X," then the rules engine can interpret the stored rules to determine which, if any, of the rules apply. In such embodiments, the alarm sensed output is a rule engine input. Other rule engine inputs can include time of day, day of week/month/year, etc. The rule engine can produce an alert response when one of the rules applies such as "door opened between 9 AM and 3 PM" in which the alert response can be to send a message to homeowner and to the neighbor across the street. Here, the rules engine interprets two conditions, door opened and time within specified range. The two condition being true, a logic AND operation indicates that messages are to be sent. Other logic operations include OR, NOR, NAND, EQUAL, GREATER THAN, LESS THAN, and a combination thereof. In any event, the rules engine can produce alert responses and the alert system can send messages to recipients based on the alert responses.

The recipient can be a remote console that produces an alert as detailed above. The remote console can be a device specifically designed for use with the alert system. A properly programmed smartphone or tablet computer can also be a recipient that alerts whoever is carrying or otherwise possessing the smartphone or tablet computer.

It is a yet further aspect of the embodiments that a person can generate a personal alert that is communicated directly to the alert system. For example, a person can manipulate an alerting device such that the alerting device sends the personal alert. The personal alert can indicate injury, need medical help, trapped in room, home invasion, or some other event.

BRIEF DESCRIPTION OF THE DRAWINGS

The accompanying figures, in which like reference numerals refer to identical or functionally similar elements throughout the separate views and which are, incorporated in and form a part of the specification, further illustrate the present invention and, together with the background of the invention, brief summary of the invention, and detailed description of the invention, serve to explain the principles of the present invention.

DETAILED DESCRIPTION

Figure 1:
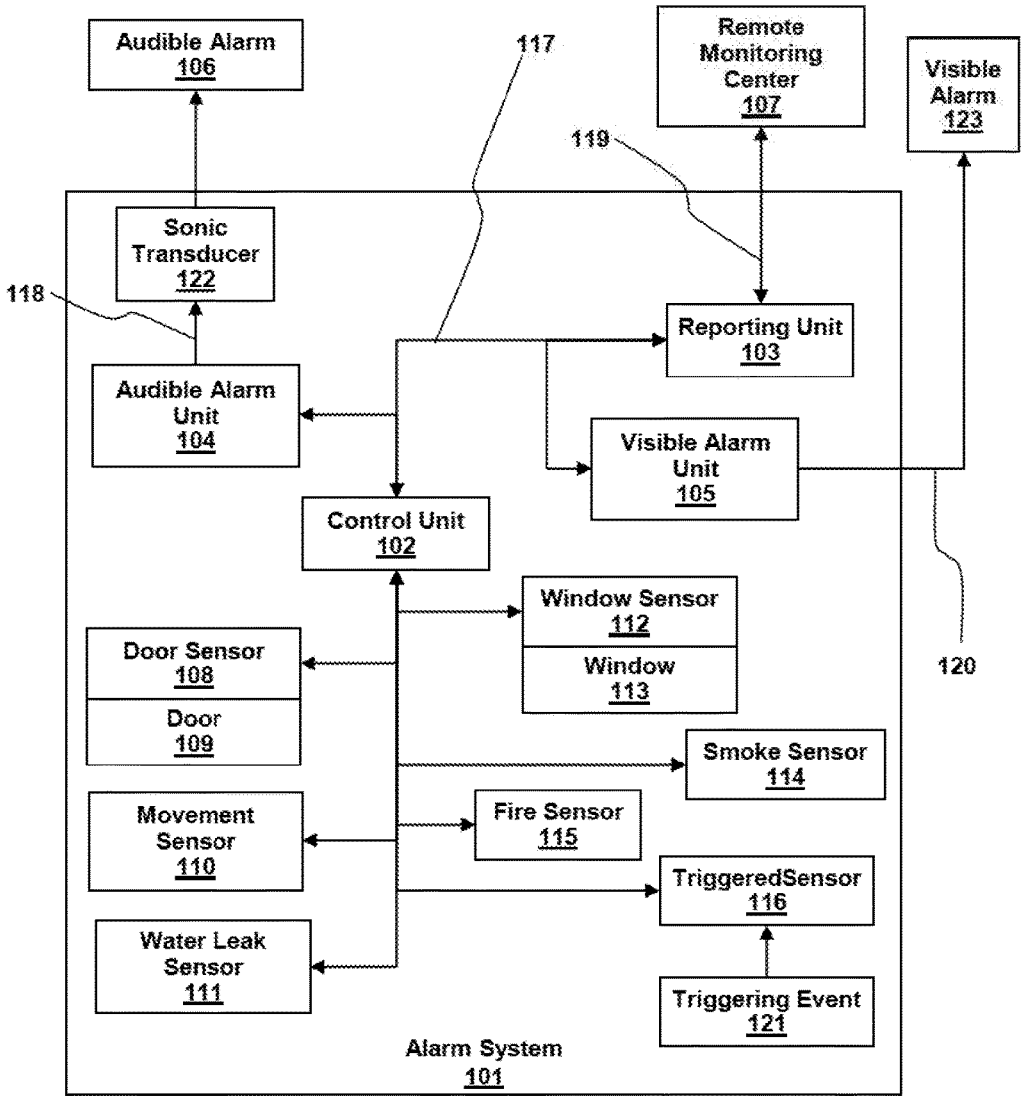
Fig. 1 (Prior Art)
FIG. 1, labeled as prior art, illustrates an alarm system with an audible alarm and a communications channel to a remote monitoring center.

The particular values and configurations discussed in these non-limiting examples can be varied and are cited merely to illustrate at least one embodiment and are not intended to limit the scope thereof. In general, the figures are not to scale.

An alarm system is monitored by an alert system that supplements the capabilities of the alarm system. The sensors, such as door sensors, window sensors, fire sensors, smoke sensors, water leak sensors, movement sensors, and CO sensors can be monitored by the alarm system which can raise an alarm when a sensor is triggered. The alert system detects that the alarm system has raised an alarm. The alert system can then communicate the alarm locally to other alert system installations. People at those other alert system installations are thereby alerted to the alarm and can respond to it.

U.S. Provisional Application 62/295,455, entitled "Alarm System for Reducing Response Time," was filed by Skolnik et al. on Feb. 15, 2016 and is herein incorporated by reference in its entirety. U.S. 62/295,455 teaches alert systems and methods that can monitor an alarm system and communicate alert signals to people, such as neighbors, who are more able to rapidly respond to a situation. It is for these teachings, amongst others, that U.S. 62/295,455 is herein incorporated by reference in its entirety.

U.S. Provisional Application 62/396,058, entitled "Neighbor to Neighbor Emergency Aiding System," was filed by Harness et al. on Sep. 16, 2016 and is herein incorporated by reference in its entirety. U.S. 62/396,058 teaches alert systems and methods that can monitor an alarm system and communicate alert signals to people, such as neighbors, who are more able to rapidly respond to a situation. The systems and methods can leverage existing infrastructure that is not part of the alarm system such as WiFi, cellular, and other networks. The systems and methods also introduce devices that can be triggered by an event or by a person wherein those devices communicate directly with the alert system and are not part of the alarm system. It is for these teachings, amongst others, that U.S. 62/396,058 is herein incorporated by reference in its entirety.

U.S. Provisional Application 62/457,550, entitled "Alarm System Response Time Reduction," was filed by Skolnik et al. on Feb. 10, 2017, and is herein incorporated by reference in its entirety. U.S. 62/457,550 teaches alert systems and methods that can monitor an alarm system such that people who are more able to rapidly respond to a situation are alerted to the situation. It is for these teachings, amongst others, that U.S. 62/457,550 is herein incorporated by reference in its entirety.

Traditionally, an alarm system consists of sensors, and a control unit. When a sensor is triggered, the alarm system calls a monitoring center and sends a signal to a siren. Aspects of the embodiments may interface with an existing alarm system to detect when the siren of an existing alarm system is activated, and send a wireless signal to a remote console. The remote console receives the signal and alerts a person manning the device.

Aspects of certain embodiments can take inputs wirelessly from user input via key fobs or an application on a smartphone that pushes the data to neighbors or remote consoles through local means or the Internet. Local means here refers to communications systems that do not extend past a local area such as a neighborhood. Such local means include Bluetooth, WiFi, and mesh networks having short range links.

Wireless communication devices such as transceivers, transmitters, and receivers are devices that transmit and/or receive wireless signals. Wireless communications include cellular, Bluetooth, and WiFi. Wireless systems are often deployed when wired connections are undesired, inconvenient, or too restrictive. Mesh networks are gaining popularity as fault tolerant wireless networks. Those practiced in the art of communications have knowledge of communications networks and networking using Bluetooth, WiFi, cellular, and meshes.

Aspect of the embodiments can give neighbors the appropriate information in an emergency so that the neighbors can support one another in order to respond to or prevent crime, fire, medical, and other forms of emergencies. The embodiments employ a plurality of electronic devices, existing information technology infrastructure such as Internet and cellular networks, and private local networks in order to disperse the needed information in an emergency to neighbors and other people who are close enough to respond in time to make a substantial difference. Below are the details of certain embodiments; however, this does not limit other embodiments from using other suitable methods or materials. Those skilled in the art will appreciate that the following descriptions are, related to exemplary embodiments and are not intended to limit the embodiments to the examples.

Figure 2:
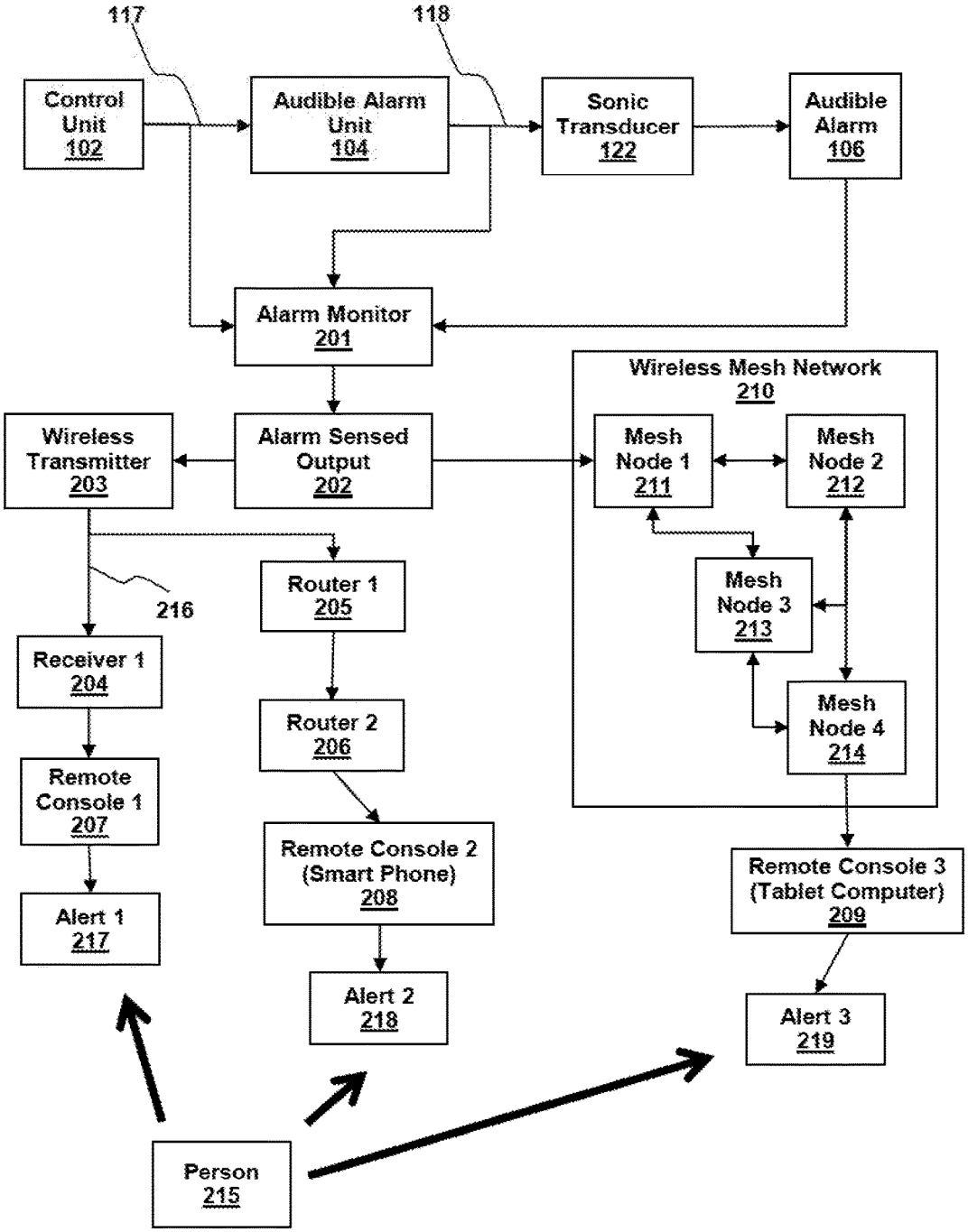
FIG. 2 illustrates an alert system monitoring an alarm system in accordance with aspects of the embodiments.

FIG. 2 illustrates an alert system monitoring an alarm system in accordance with aspects of the embodiments. Within the alarm system, a control signal 117 is produced by the control unit 102. The control signal 117 can then pass to the audible alarm unit 104 that produces alarm signal 118 which results in audible alarm 106 being produced by sonic transducer 122. The alarm monitor can detect that the control signal 117 has changed states by detecting a change in the control signal 117, by detecting the alarm signal 118, or by detecting the audible alarm 106. An audible alarm 106 can be sensed by a microphone and detected by passing sensed audio from the microphone to a discriminator that recognizes the audible alarm 106 based on its volume or some other factors. Systems and methods for recognizing sounds are widely available. Embodiments can pass the alarm signal 118 to the discriminator when the alarm signal 118 is substantially similar to the signal produced by a microphone near the sonic transducer 122.

The alarm monitor 201 produces an alarm sensed output 202 that can be input into a wireless transmitter 203 or into an entry node 211 of a wireless mesh network 210. The wireless transmitter can send an alert signal 216 directly to receiver 1 204 such that alert 1 217 is displayed on remote console 1 207. A person 215 can notice alert 1 217 and respond accordingly. An alert signal 216 can be a simple analog signal that, when present, indicates a triggering event is detected. Alternatively, an alert signal 216 can be packetized data such as the information exchanged on the internet. The packetized data can indicate which sensors are triggered, which sensors are not triggered, and other information about the alarm system and the alert system.

The wireless transmitter can communicate the alert signal 216 to router 1 205 from where it is routed to router 2 206 and thence to remote console 2 208. Here, the alert signal 216 can be a message transmitted over the internet, a cell phone network, or some other data transmission network. The recipient 238 of the alert signal 218 can be a smartphone that provides alert 2 218 to a person 215.

Alert signals 216 and messages can transit a wireless mesh network 210 having mesh nodes such as mesh node 1 211, mesh node 2 212, mesh node 3 213, and mesh node 4 214. Those practiced in the art of communications know of numerous mesh node implementations. As illustrated, mesh node 1 211 is an input node and mesh node 4 214 is an output node that passes the alert signal to remote console 3 209. Remote console 3 209, which can be a tablet computer or other device configured to connect to mesh network 210, can provide alert 3 219 to the person 215.

Figure 3:
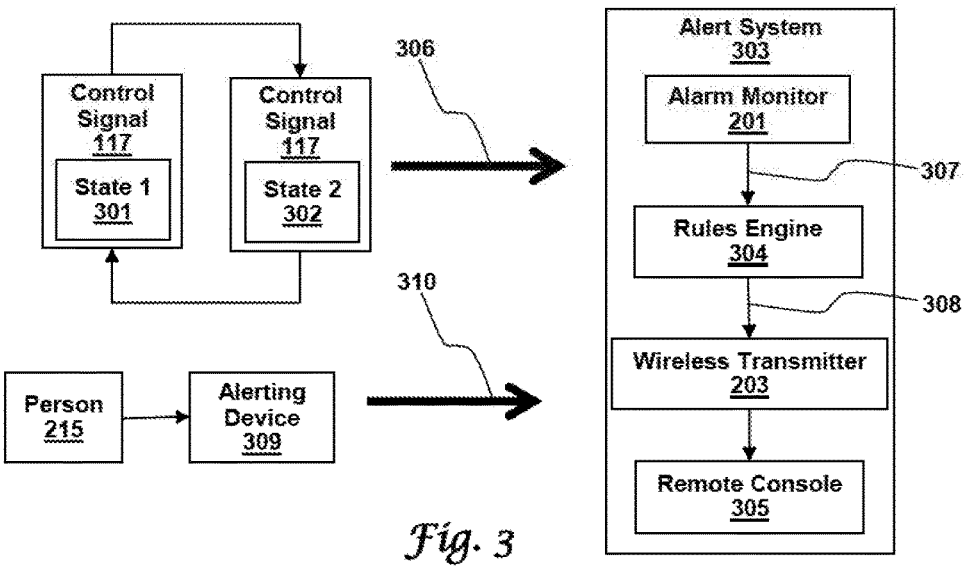
FIG. 3 illustrates an alert system with a rules engine in accordance with aspects of the embodiments.

FIG. 3 illustrates an alert system 303 with a rules engine 304 in accordance with aspects of the embodiments. A control signal 117 can change state by transitioning from state 1 301 to state 2 302. The states indicate the status or condition of the alarm system. The states can be as simple as "all clear" and "something wrong" or can be indications of the status of individual components of the alarm system. For example, state 1 301 can indicate that no sensor is triggered, that every sensor is operational and other information such as device identifiers for alarm system components. State 2 302 can contain substantially the same information with the exception of indicating that one or more sensors is currently triggered.

Alarm monitor 201 can observe the control signal 117 and can detect when control signal 117 changes state. On detecting a state change, alarm monitor 201 can produce alarm sensed output 307. Alarm sensed output can be as simple as a binary indicator of "alarm sensed" or "no alarm sensed." Alternatively, the alarm sensed output 307 can incorporate some or all of the information contained in the control signal 117 as well as additional information such as the location or identity of the alarm monitor 201. A rules engine 304 can receive the alarm sensed output 307 and produce alert responses 308. An alert response 308 can be as simple as a binary signal resulting in an analog transmission from a wireless transmitter 203 that is hopefully received by a remote console 305 at a neighbor's house. An example of such a remote console 305 is simple receiver and buzzer/light combination that lights up or sounds when the receiver detects the analog transmission. Alternatively, as seen in FIG. 2, the alert response 308 can be as complex as a packetized data structure and the wireless transmitter 203, a wireless internet router, or similar device.

The alert system can also monitor an alerting device 309 operated by a person 215. In this manner, the person 215 can raise an alarm or send an alert to friends and neighbors without incurring any overhead from a home monitoring company or causing an automatic police response, Alarm systems are often monitored by home or business monitoring companies that have defined procedures to follow when they receive a notification from the alarm system. The procedures can incur costs an penalties. The alert system does not incur those costs and penalties. In this manner, a person 215 can call for help from a neighbor having a remote console and thereby get a more immediate and less costly response.

Figure 4:
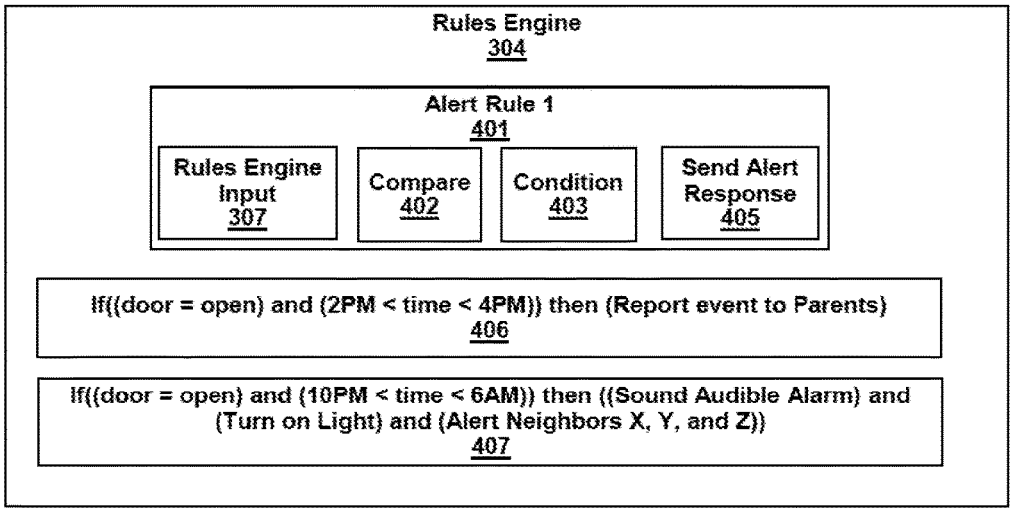
FIG. 4 illustrates alert rules stored in a rules engine in accordance with aspects of the embodiments.

FIG. 4 illustrates alert rules 401, 406, 407 stored in a rules engine 304 in accordance with aspects of the embodiments. A rules engine can accept a rules engine input and test it against the stored rules. Alert rule 1 401 is an example of a simple rule that compares 402 a rule engine input 307 against a condition 403. If the condition 403 is met, then an alert response 405 can be sent. Alert rule 406 is a more complicated rule having numerous comparisons against numerous conditions. For example, "door" is a rule engine input indicating the status of one or more doors, "open" is a condition, and "=" is a comparison. Another rule engine input, the time of day, can come from a number of sources. The time of day can be tested against a time period. If both of the conditions, as indicated by the logical "and," are true, then an alert response of alerting "parents" can be performed. Alert rule 3 407 is a similar rule having a different alert response. Those practiced in the arts of logic or programming will understand the function of rules engine 304.

Figure 5:
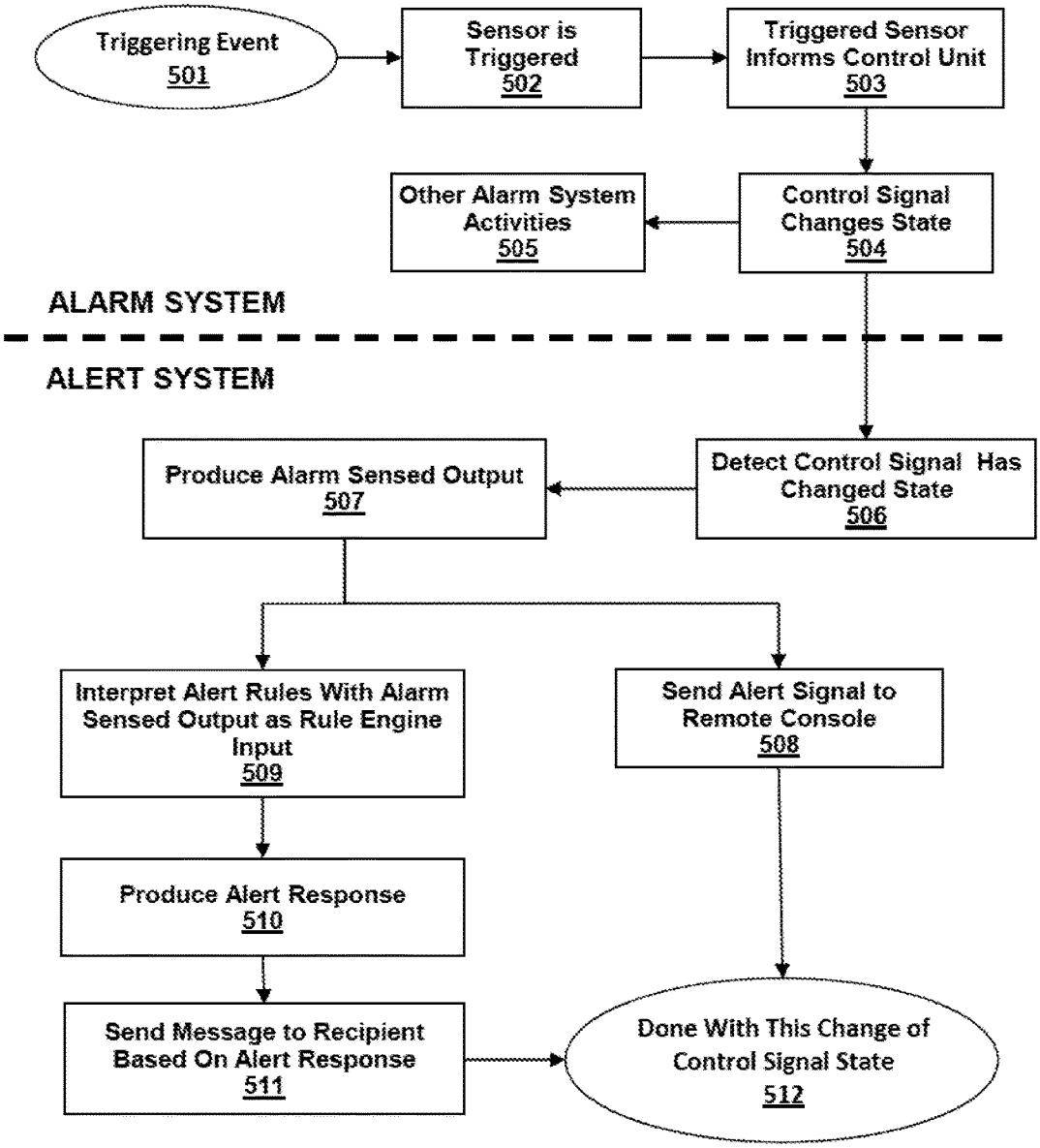
FIG. 5 illustrates a high level flow diagram of an alert, system sending alert signals and messages in accordance with aspects of the embodiments.

FIG. 5 illustrates a high level flow diagram of an alert system sending alert signals and messages in accordance with aspects of the embodiments. The process begins in the alarm system when a triggering event 501 causes a sensor to trigger 502. The control unit is informed of the triggering 503 and reacts by changing the state of a control signal 504. The system then proceeds with other alarm system activities 505.

The alert system takes action upon detecting that the control signal has changed state 506 by producing an alarm sensed signal 507. The alarm sensed signal can cause the alert system to send an alert signal to a remote console 508, The alarm sensed signal can also be interpreted by a rules engine 509 that produces an alert response 510 that is sent to a recipient 511. The alert system is then done responding to that one particular change of control signal state 512.

Figure 6:
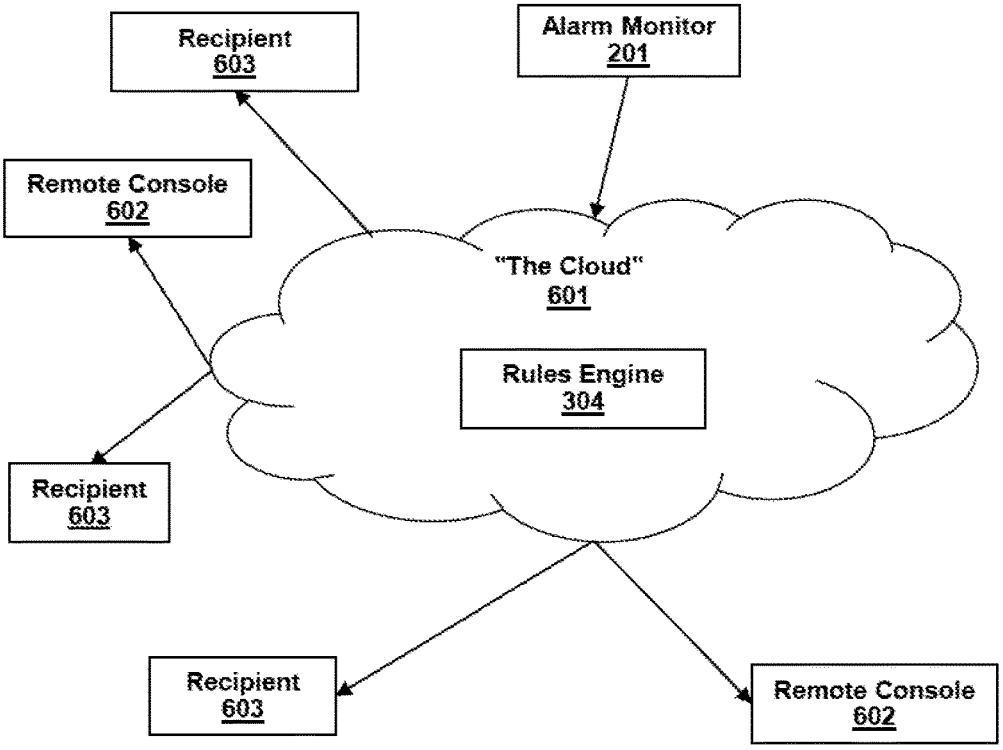
FIG. 6 illustrates a cloud based implementation of a rules engine in accordance with aspects of the embodiments.

FIG. 6 illustrates a cloud based implementation of a rules engine in accordance with aspects of the embodiments. The alarm monitor 201 can send its alarm sensed output to a remote computer or service running "in the cloud." Those practiced in current computer systems architecture will recognize that "the cloud" 601 refers to computers, virtual computers, instances, or triggered code that are run as a service by a cloud service provider. In some cases, the rules engine can run as a service or application on what appears to be a server, but is likely an instance or virtual machine. In other cases, the rules engine is simply an end point or API surfaced by a cloud provider that can receive a message and perform an operation such as examining the message and performing operations based on the message contents. Here, the alert sensed output can be the message that is examined and interpreted by the rules engine 304 that then, in accordance with the stored rules, sends alert signals or messages to remote consoles 602 and other recipients 603.

It is noted that, as used in this specification and the appended claims, the singular forms "a," "an," and "the" include plural referents unless expressly and unequivocally limited to one referent. As used herein, the term "include" and its grammatical variants are intended to be non-limiting, such that the recitation of items in a list is not to the exclusion of other like items that can be substituted or other items that can be added to the listed items.

It will be appreciated that variations of the above-disclosed and other features and functions, or alternatives thereof, may be desirably combined into many other different systems or applications. Also, that various presently unforeseen or anticipated alternatives, modifications, variations or improvements therein may be subsequently made by those skilled in the art which are also intended to be encompassed by the following claims.

What is claimed is:

1. An alert system that enhances a substantially separate alarm system, wherein the alarm system comprises a control unit and at least one sensor, wherein the at least one sensor detects a triggering event, wherein the at least one sensor informs the control unit of the triggering event, and wherein the alarm system responds to the triggering event by changing the state of a control signal, the alert system comprising:

an alarm monitor, wherein the alarm monitor detects that the control signal has changed state, wherein the alarm monitor produces an alarm sensed output in response to detecting that the control signal has changed state, and wherein the control signal does not comprise the alarm sensed output;

a wireless transmitter wherein the alarm sensed output causes the wireless transmitter to transmit an alert signal;

a remote console wherein the remote console receives the alert signal directly from the wireless transmitter and generates an alert, wherein the alert is perceptible by a person, and wherein the alert informs the person of the triggering event;

wherein the alarm system further comprises a reporting unit wherein the reporting unit receives the control signal, wherein the reporting unit informs a remote monitoring center of the triggering event, wherein the alert system does not comprise the reporting unit, and wherein the remote console is not located at the remote monitoring center;

wherein the alert system sends another message to another recipient based on the at least one alert sensed output, wherein the other recipient is a smartphone or tablet computer, wherein the other recipient produces an alert that is perceptible by a person, and wherein the other message traverses a wireless mesh network before reaching the other recipient;

wherein the alert system sends a third message to a third recipient based on the at least one alert sensed output, wherein the third recipient is a smartphone or tablet computer, wherein the third recipient produces an alert that is perceptible by a person, and wherein the third message traverses a cellular network;

wherein the alarm monitor is connected to the alarm system by a wired connection between the control unit and the alarm unit and wherein the alarm monitor senses the control signal on the wired connection;

wherein the alarm system further comprises an audible alarm unit, wherein the audible alarm unit responds to the control signal by providing an alarm signal to a sonic transducer that converts electrical energy to sonic energy to produce an audible alarm, wherein the alarm monitor directly detects the alarm signal, and wherein the alarm monitor detects the audible alarm; and wherein the alarm monitor further produces an alarm sensed output in response to detection of a personal alert generated by an independent alerting device operated by a person.

2. The alert system of claim 1 wherein the alarm monitor directly monitors the control signal.

3. The alert system of claim 1 wherein the alarm system further comprises an audible alarm unit, wherein the audible alarm unit responds to the control signal by producing an audible alarm, and wherein the alarm monitor senses the control signal on a wired connection between the control unit and the audible alarm unit.

4. The alert system of claim 1 wherein the alarm system further comprises an audible alarm unit, wherein the audible alarm unit responds to the control signal by providing an alarm signal to a sonic transducer that converts electrical energy to sonic energy, and wherein the alarm monitor detects that the control signal has changed state by directly detecting the alarm signal.

5. The alert system of claim 1 wherein the alert signal traverses a cellular network before reaching the remote console.

6. An alert system that enhances a substantially separate alarm system, wherein the alarm system comprises a control unit and at least one sensor, wherein the at least one sensor detects a triggering event, wherein the at least one sensor informs the control unit of the triggering event, and wherein the alarm system responds to the triggering event by changing the state of a control signal, the alert system comprising:

an alarm monitor, wherein the alarm monitor detects that the control signal has changed state, wherein the alarm monitor produces an alarm sensed output in response to detecting that the control signal has changed state, and wherein the control signal does not comprise the alarm sensed output;

a rules engine storing a plurality of alert rules, wherein the rules engine accepts at least one rules engine input, wherein the rules engine produces at least one alert response by testing the at least one rule engine input against at least one condition, and wherein the at least one rule engine input comprises the alarm sensed output; wherein the alert system sends a message to a recipient based on the at least one alert response;

a wireless transmitter that transmits the message directly to a remote console, wherein the remote console receives the message and generates an alert, wherein the alert is perceptible by a person, and wherein the alert informs the person of the triggering event;

wherein the alarm system further comprises a reporting unit wherein the reporting unit receives the control signal, wherein the reporting unit informs a remote monitoring center of the triggering event, wherein the alert system does not comprise the reporting unit, and wherein the remote console is not located at the remote monitoring center;

wherein the alert system sends another message to another recipient based on the at least one alert response, wherein the another recipient is a smartphone or tablet computer and wherein the another recipient produces an alert that is perceptible by a person, wherein the another message traverses a wireless mesh network before reaching the another recipient;

wherein the alert system sends a third message to a third recipient based on the at least one alert response, wherein the third recipient is a smartphone or tablet computer, wherein the third recipient produces an alert that is perceptible by a person, and wherein the third message traverses a cellular network;

wherein the alarm monitor is connected to the alarm system by a wired connection between the control unit and the alarm unit and wherein the alarm monitor senses the control signal on the wired connection;

wherein the alarm system further comprises an audible alarm unit, wherein the audible alarm unit responds to the control signal by providing an alarm signal to a sonic transducer that converts electrical energy to sonic energy to produce an audible alarm, wherein the alarm monitor directly detects the alarm signal, and wherein the alarm monitor detects the audible alarm;

wherein a person manipulates an alerting device to thereby produce a personal alert, and wherein the at least one rule engine input comprises the personal alert.

7. The alert system of claim 6 wherein a recipient is a smartphone or tablet computer and wherein the recipient produces an alert that is perceptible by a person.

8. A method for monitoring an alarm system by an independent alert system, wherein the alarm system comprises a control unit, an audible alarm unit and at least one sensor, the method comprising:

connecting the alarm system to an alarm monitor of the alert system by a wired connection between the control unit and the alarm unit and wherein the alarm monitor senses the control signal on the wired connection;

causing a control signal of the alarm system to change state, wherein a triggered sensor detects a triggering event, wherein the triggered sensor is one of the at least one sensor, wherein the triggered sensor informs the control unit of the triggering event, wherein the alarm system responds to the triggering event by changing the control signal;

storing a plurality of alert rules that each test at least one rule engine input against at least one condition;

detecting, by an alarm monitor of the alert system, that the control signal has changed state;

detecting, by the alarm monitor of the alert system, a personal alert signal, the personal alert signal transmitted from the personal alerting device in response to manipulation of the personal alerting device by a person;

interpreting a first alert rule wherein the at least one rule engine input comprises the control signal;

interpreting a second alert rule wherein the at least one rule engine input comprises the personal alert signal;

producing an alarm sensed output, by the alert system, in response to interpreting a second alert rule detecting a personal alert signal, or interpreting a first alert rule that the control signal has changed state, and wherein the control signal does not comprise the alarm sensed output;

transmitting, by the alert system, an alert signal via wireless transmitter directly to a remote console wherein the remote console receives the alert signal and generates an alert, wherein the alert is perceptible by a person, and wherein the alert informs the person of the triggering event;

receiving the control signal in a reporting unit of the alarm system, wherein the reporting unit informs a remote monitoring center of the triggering event, wherein the alert system does not comprise the reporting unit, and wherein the remote console is not located at the remote monitoring center;

sending another message via the alert system to another recipient based on the alarm sensed output, wherein the another recipient is a smartphone or tablet computer wherein the another recipient produces another alert that is perceptible by a person, and wherein the another message traverses a wireless mesh network before reaching the another recipient;

sending a third message via the alert system to a third recipient based on the alarm sensed output, wherein the third recipient is a smartphone or tablet computer, wherein the third recipient produces a third alert that is perceptible by a person, and wherein the third message traverses a cellular network; and responding to the control signal via the audible alarm unit, wherein the audible alarm unit responds to the control signal by providing an alarm signal to a sonic transducer that converts electrical energy to sonic energy to produce an audible alarm, wherein the alarm monitor of the alert system directly detects the alarm signal, and wherein the alarm monitor detects the audible alarm.

* * * * *